US010472160B2

(12) United States Patent
Lee

(10) Patent No.: US 10,472,160 B2
(45) Date of Patent: Nov. 12, 2019

(54) COMPACT CONTAINER HAVING CONTENTS STORAGE CONTAINER HORIZONTALLY COUPLED TO LATERAL SIDE OF PUMP

(71) Applicant: PUM-TECH KOREA CO., LTD, Incheon (KR)

(72) Inventor: Do Hoon Lee, Incheon (KR)

(73) Assignee: PUM-TECH KOREA CO., LTD., Incheon (KR)

( * ) Notice: Subject to any disclaimer, the term of this patent is extended or adjusted under 35 U.S.C. 154(b) by 93 days.

(21) Appl. No.: 15/739,644

(22) PCT Filed: Jun. 27, 2016

(86) PCT No.: PCT/KR2016/006861
§ 371 (c)(1),
(2) Date: Dec. 22, 2017

(87) PCT Pub. No.: WO2017/010702
PCT Pub. Date: Jan. 19, 2017

(65) Prior Publication Data

US 2018/0186551 A1 Jul. 5, 2018

(30) Foreign Application Priority Data

Jul. 13, 2015 (KR) ..... 10-2015-0099396

(51) Int. Cl.
*B65D 83/00* (2006.01)
*A45D 34/04* (2006.01)
(Continued)

(52) U.S. Cl.
CPC ..... *B65D 83/0044* (2013.01); *A45D 34/042* (2013.01); *A45D 34/06* (2013.01);
(Continued)

(58) Field of Classification Search
CPC ..... B65D 83/0044; B65D 83/0005; A45D 34/042; A45D 34/06; A45D 40/00; A45D 2200/056
(Continued)

(56) References Cited

U.S. PATENT DOCUMENTS 5,226,541 A * 7/1993 Huang ..... A45D 40/00 132/294
5,301,808 A * 4/1994 Pierson ..... A45D 40/24 132/297
(Continued)

FOREIGN PATENT DOCUMENTS

KR 20-0437870 Y1 1/2008
KR 10-0963155 B1 6/2010
(Continued)

*Primary Examiner* — Robert Poon
(74) *Attorney, Agent, or Firm* — Heedong Chae; Lucem, PC

(57) ABSTRACT

The present invention includes a compact container, having a contents storage container horizontally coupled to the lateral side of a pump, comprising: a container body to which a container lid is hinge-coupled; a contents discharge frame which has a pump mounting portion formed on the center and a contents inlet port formed, in the horizontal direction, on one side of the outer peripheral surface of the pump mounting portion; a pump which is vertically mounted on the pump mounting portion; a discharge plate which is formed on the upper part of the pump; a contents storage container which is horizontally mounted on the contents inlet port; and a fixing member which has a puff equipment space formed on the upper part thereof and is for fixing the contents discharge frame and contents storage container to the container body.

5 Claims, 8 Drawing Sheets

(51) Int. Cl.

| | |
|---|---|
| ***A45D 34/06*** | (2006.01) |
| ***A45D 40/22*** | (2006.01) |
| ***A45D 40/24*** | (2006.01) |
| ***B65D 47/20*** | (2006.01) |
| *A45D 40/00* | (2006.01) |

(52) U.S. Cl.
CPC ..... *A45D 40/222* (2013.01); *A45D 40/24* (2013.01); *B65D 47/2087* (2013.01); *A45D 2040/0006* (2013.01); *A45D 2200/055* (2013.01); *A45D 2200/056* (2013.01)

(58) Field of Classification Search
USPC ..... 206/581, 823
See application file for complete search history.

(56) References Cited

U.S. PATENT DOCUMENTS

| | | | | |
|---|---|---|---|---|
| 2002/0084207 | A1* | 7/2002 | Mann | A44C 7/001 206/581 |
| 2006/0118454 | A1* | 6/2006 | Kang | A45D 33/006 206/581 |
| 2013/0075423 | A1* | 3/2013 | Rossignol | A45D 34/04 222/105 |
| 2014/0001210 | A1* | 1/2014 | Lim | A45D 33/006 222/162 |
| 2014/0231454 | A1* | 8/2014 | Rossignol | B65D 35/28 222/105 |
| 2016/0015149 | A1* | 1/2016 | Kim | A45D 34/00 222/383.1 |
| 2016/0227903 | A1* | 8/2016 | Kang | A45D 34/00 |

FOREIGN PATENT DOCUMENTS

| | | | |
|---|---|---|---|
| KR | 10-1231786 | B1 | 2/2013 |
| KR | 10-1324263 | B1 | 11/2013 |
| KR | 10-2014-0086330 | A | 7/2014 |

* cited by examiner

-- PRIOR ART --

-- PRIOR ART --

COMPACT CONTAINER HAVING CONTENTS STORAGE CONTAINER HORIZONTALLY COUPLED TO LATERAL SIDE OF PUMP

CROSS-REFERENCE TO RELATED APPLICATION

This application claims the benefit of Korean application No. 10-2015-0099396, filed on Jul. 13, 2015 with the Korean Intellectual Property Office, the disclosure of which is incorporated herein by reference.

TECHNICAL FIELD

The present invention relates to a compact container having a contents storage container horizontally coupled to the lateral side of a pump and, more specifically, to a compact container having a contents storage container horizontally coupled to the lateral side of a pump, which includes a container body to which a container lid is hinge-coupled, a contents discharge frame which has a pump mounting portion formed on the center and a contests inlet port formed in the horizontal direction on one side of the outer peripheral surface of the pump mounting portion, a pump which is vertically mounted on the pump mounting portion, a discharge plate which is formed on the upper part of the pump, a contents storage container which is horizontally mounted on the contents inlet port, and a fixing member which has a puff equipment space formed on the upper part thereof and is for fixing the contents discharge frame and contents storage container to the container body, wherein the contents storage container is horizontally coupled to the pump, which is vertically mounted, thereby providing a pump installation space and a contents storage container installation space as separate and enabling storage of a large amount of contents.

BACKGROUND ART

Color cosmetics, which are used to beautifully adorn the skin of a user by making the appearance beautiful, are classified into a base makeup used for making a skin color uniform and covering a defect and a point makeup used for partially enhancing a three-dimensional effect of a lip, eyes, or nails. The base makeup includes a makeup base, a foundation and a powder, and the point makeup includes a lipstick, an eye liner, and mascara.

The foundation is classified into solid-type foundation, liquid-type foundation and gel-type foundation according to a type of cosmetic contents. In case of the solid-type foundation, although the solid-type foundation has a good cover effect, the makeup is united when the makeup is refreshed. In case of the liquid-type foundation, although the liquid-type foundation gives a good close contact feel, the persistency is weak. Thus, in recent years, the number of customers who prefer the gel-type foundation, which has a considerable persistency and provides a good feeling when it is applied to the skin, has been increased.

Therefore, there is a need to develop a container for gel-type foundation. Generally, the gel-type foundation, which is filled into a glass container or a tube-type container, is used in such a manner that a user takes some foundation on user's hands for use or squeezes foundation from the container and then, applies the foundation on the user's skin by using a puff or user's hands.

However, according to the related art, since the user gets cosmetics on user's hand whenever using the cosmetics, it is inconvenient to wash hands every time after use. In addition, as the hands coated with cosmetics are washed, the cosmetics are wasted.

To solve the above problems, there has been disclosed a compact container for cosmetics in Korean Registered Utility Model No. 20-047396, as shown in FIG. 1, where an inner container is contained in a container body, a sponge in which a cosmetic material is impregnated is kept in the inner container, an inner container lid is hinge-coupled to an upper portion of the inner container, and a compact lit is formed on the inner container lid and hinge-coupled to the container body. Thus, the container may be opened and the cosmetic material impregnated in a sponge in the container may be stuck on a puff to be applied to the skin, so that the cosmetic material may be easily used without being stuck on hands.

However, according to the related art, when the cosmetic material is exposed to an outside of the inner container, the volatile raw material is volatilized to be hardened, so that the original function may be lost. When the cosmetic material is stuck on the puff, it may be difficult to use a certain amount of cosmetic material, so that the cosmetic material is wasted.

To solve the above problems, as shown in FIG. 2, a compact container having a pump is disclosed in Korean Registered Utility Model No. 20-0476239 issued to the applicant of the present application, where an inner container in which a cosmetic material is stored is contained in a container body, a cover for covering the inner container is installed inside the inner container to seal the inner container, a pump is installed at the center of the inner container, and a pump operation plate is attached to the upper portion of the pump. When the pump operation plate is pushed, the pump is operated so that the cosmetic material contained in the inner container is discharged at a certain amount through a hole of the pump operation plate, thereby preventing the volatile raw material of the cosmetic material from being volatilized into the air.

However, according to the related art, since the pump is located at the center of the container body and the space for storing the cosmetics in the container is small, the cosmetic material may be used only for a short time period.

In addition, according to the related art, since the inner container in which the cosmetic material stored is sealed to prevent the cover from being separated from the upper portion thereof, a user cannot refill the inner container after the cosmetic material is used up, so that the entire compact container must be discarded, thereby increasing the purchasing cost.

In addition, since the compact container is required to have a puff keeping space on the pump operation plate to keep the puff, the compact container becomes thick and inconvenient to carry and the appearance is poor.

In addition, according to the compact container, since the inner container is assembled into the container body, the cosmetic material is injected into the inner container and then, the cover is assembled with the inner container, the manufacturing process of the compact container is inefficient.

DISCLOSURE

Technical Problem

To solve the problems described above, one object of the present invention is to provide a compact container having a contents storage container horizontally coupled to the lateral side of a pump, which includes a container body to which a container lid is hinge-coupled, a contents discharge frame which has a pump mounting portion formed on the center and a contents inlet port formed in the horizontal direction on one side of the outer peripheral surface of the pump mounting portion, a pump which is vertically mounted on the pump mounting portion, a discharge plate which is formed on the upper part of the pump, a contents storage container which is horizontally mounted on the contents inlet port, and a fixing member which has a puff equipment space formed on the upper part thereof and is for fixing the contents discharge frame and contents storage container to the container body, wherein the contents storage container is horizontally coupled to the pump, which is vertically mounted, thereby providing a pump installation space and a contents storage container installation space as separate and enabling storage of a large amount of contents.

Another object of the present invention is to provide a compact container having a contents storage container horizontally coupled to the lateral side of a pump, which is capable of enabling the contents storage container to be easily combined with and separated from the contents discharge frame to easily refill the contents storage container after the contents in the contents storage container are used up.

Still another object of the present invention is to provide a compact container having a contents storage container horizontally coupled to the lateral side of a pump, in which a puff keeping space of the fixing member is concavely formed in the space between the contents storage container and the fixing member to keep a puff therein, such that the thickness of the compact container is minimized and the compact container is easily portable.

Still another object of the present invention is to provide a compact container having a contents storage container horizontally coupled to the lateral side of a pump, which is capable of efficiently dividing the manufacturing process to improve the productivity by separating the process of filling the contents storage container with contents from the process of assembling components to assemble the contents storage container of which the contents injection is completed together when the components are assembled.

Technical Solution

According to an aspect of the present invention, there is provided a compact container having a content storage container horizontally coupled to a side surface of a pump, which includes:

a container body (10);

a container lid (20) hinge-coupled to one side of the container body (10) to be opened and closed;

a contents discharge frame (30) installed at one side of an inner portion of the container body (10) and provided at a center thereof with a pump mounting portion (32) in a vertical direction, in which a contents inlet port (34) is provided on one side of an outer periphery of the pump mounting portion (32) in a horizontal direction;

a contents storage container (40) horizontally mounted on the contents inlet port (34) of the contents discharge frame (30);

a pump (50) vertically mounted on the pump mounting portion (32) of the contents discharge frame (30) to pump contents;

a distribution plate (60) coupled to an upper portion of the pump (50) and formed on an upper surface thereof with a discharge passage (62);

a discharge plate (70) formed on an upper portion of the distribution plate (60) and formed with a plurality of outlet ports (71); and a fixing member (80) coupled to upper portions of the contents discharge frame (30) and the contents storage container (40) to fix the contents discharge frame (30) and the contents storage container (40).

In addition, a guide groove (36) having a cross shape may be formed outside the pump mounting portion (32) of the contents discharge frame (30), and a guide protrusion (66) having a cross shape may extend downward of the distribution plate (60) and be inserted into the guide groove (36).

In addition, a sealing groove (64) may be formed outside the discharge passage (62) of the distribution plate (60), a sealing ring (68) may be fitted into the sealing groove (64), and the sealing ring (68) may be formed of a rubber ring or a double sided tape.

In addition, the compact container further includes a fixture (90) formed between the discharge plate (70) and the fixing member (80) to prevent the distribution plate 60 and the discharge plate 70 from moving left and right.

In addition, a distribution plate hole (82) for exposing the discharge plate (70) and a puff keeping space (84) for keeping a puff (P) may be formed on an upper portion of the fixing member (80).

Advantageous Effects

The compact container having a contents storage container horizontally coupled to the lateral side of a pump according to the present invention includes a container body to which a container lid is hinge-coupled, a contents discharge frame which has a pump mounting portion formed on the center and a contents inlet port formed in the horizontal direction on one side of the outer peripheral surface of the pump mounting portion, a pump which is vertically mounted on the pump mounting portion, a discharge plate which is formed on the upper part of the pump, a contents storage container which is horizontally mounted on the contents inlet port, and a fixing member which has a puff equipment space formed on the upper part thereof and is for fixing the contents discharge frame and contents storage container to the container body, wherein the contents storage container is horizontally coupled to the pump, which is vertically mounted, thereby providing a pump installation space and a contents storage container installation space as separate and enabling storage of a large amount of contents.

In addition, according to the compact container having a contents storage container horizontally coupled to the lateral side of a pump, the contents storage container may be easily combined with and separated from the contents discharge frame, so that the contents storage container is easily refilled after the contents in the contents storage container are used up.

In addition, according to the compact container having a contents storage container horizontally coupled to the lateral side of a pump, the puff keeping space of the fixing member is concavely formed in the space between the contents storage container and the fixing member to keep a puff therein, such that the thickness of the compact container may be minimized and the compact container may be easily portable.

In addition, according to the compact container having a contents storage container horizontally coupled to the lateral side of a pump, the manufacturing process is efficiently divided to improve the productivity by separating the process of filling the contents storage container with contents from the process of assembling components to assemble the contents storage container of which the contents injection is completed together when the components are assembled.

BEST MODE

Mode for Invention

Hereinafter, a compact container having a contents storage container horizontally coupled to the lateral side of a pump according to an embodiment of the present invention will be described with reference to accompanying drawings.

Figure 1:
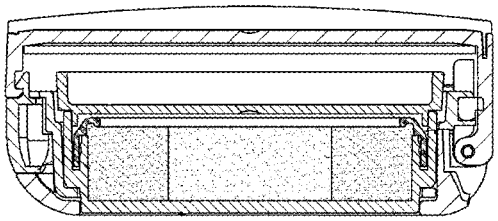
FIG. 1 is a view showing a compact container according to the related art.
Figure 2:
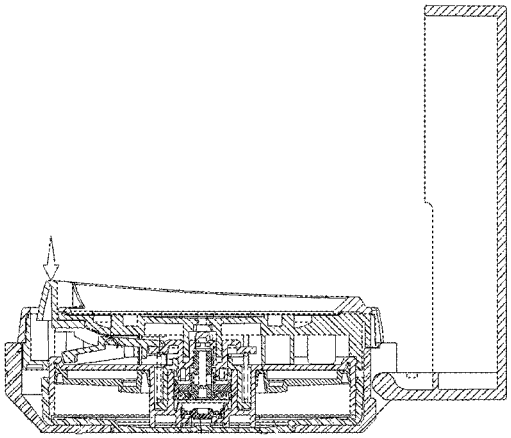
FIG. 2 is a view showing a compact container having a uniform cosmetic liquid dispensing function according to the related art.
Figure 3:
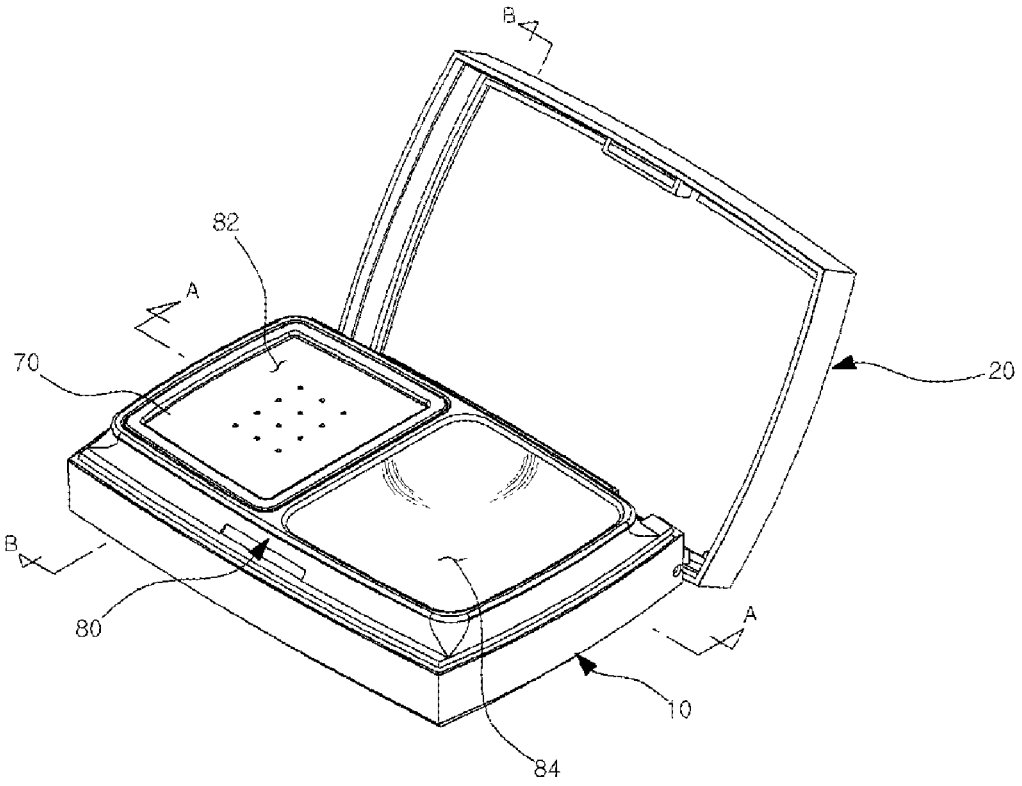
FIG. 3 is a perspective view showing a compact container having a contents storage container horizontally coupled to the lateral side of a pump according to the present invention.
Figure 4:
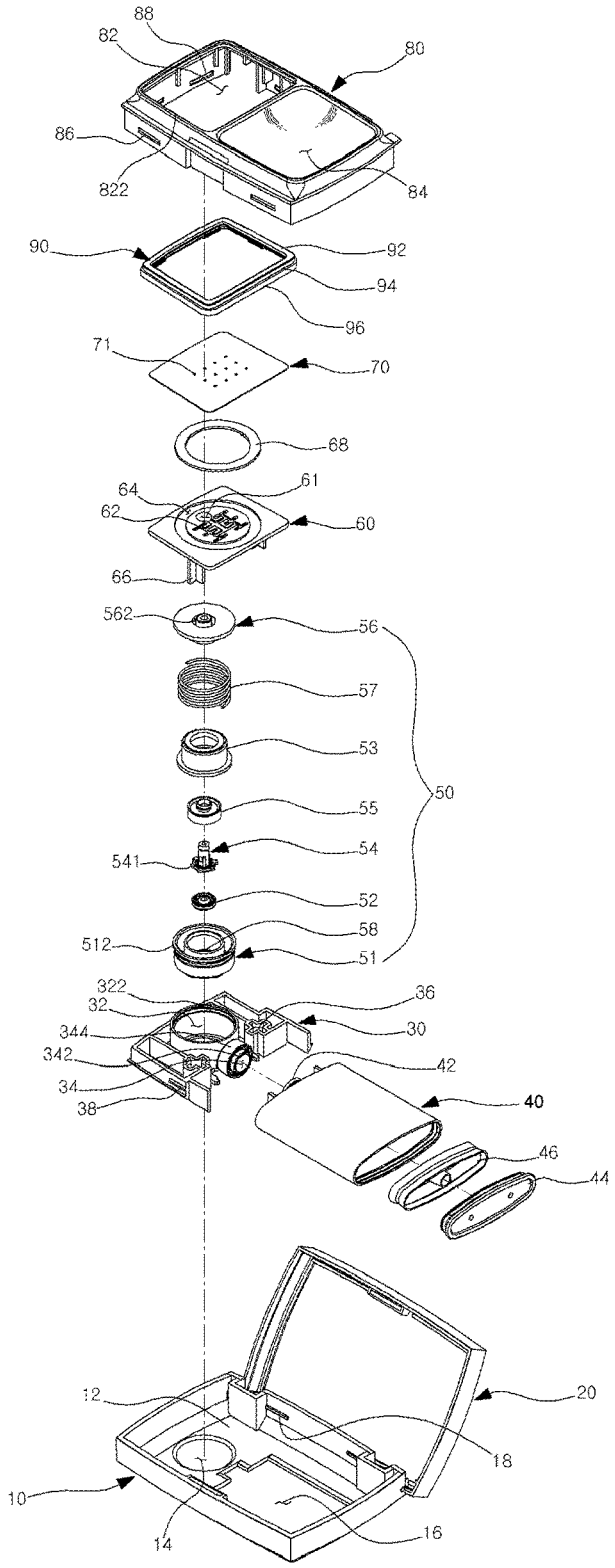
FIG. 4 is an exploded perspective view showing a compact container having a contents storage container horizontally coupled to the lateral side of a pump according to the present invention.
Figure 5:
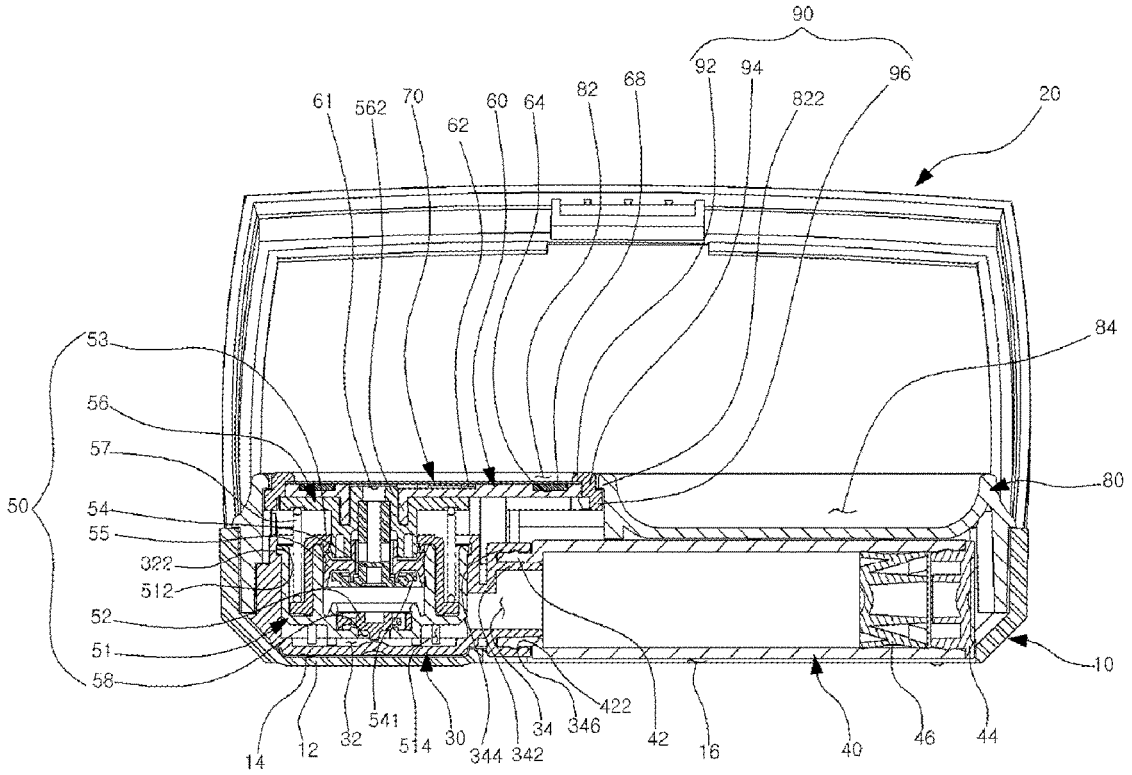
FIG. 5 is a sectional view taken along line A-A of a compact container having a contents storage container horizontally coupled to the lateral side of a pump according to the present invention.
Figure 6:
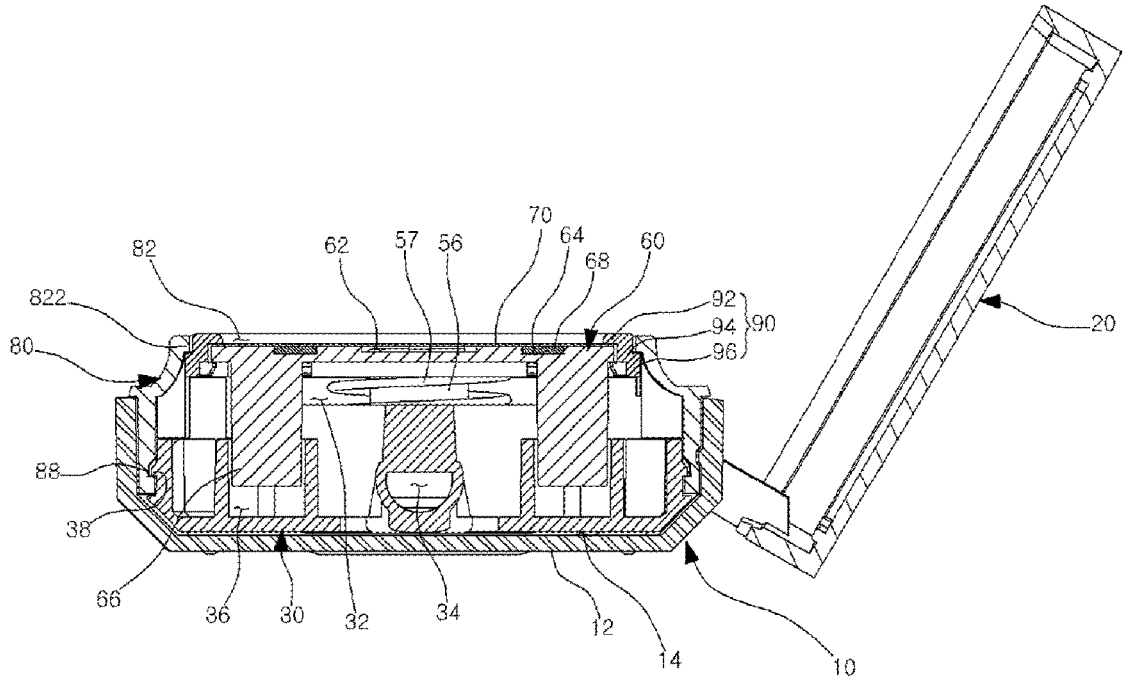
FIG. 6 is a sectional view taken along line B-B of a compact container having a contents storage container horizontally coupled to the lateral side of a pump according to the present invention.

FIG. 3 is a perspective view showing a compact container having a contents storage container horizontally coupled to the lateral side of a pump according to the present invention. FIG. 4 is an exploded perspective view showing a compact container having a contents storage container horizontally coupled to the lateral side of a pump according to the present invention. FIG. 5 is a sectional view taken along line A-A of a compact container having a contents storage container horizontally coupled to the lateral side of a pump according to the present invention. FIG. 6 is a sectional view taken along line B-B of a compact container having a contents storage container horizontally coupled to the lateral side of a pump according to the present invention.

According to the present invention, there is provided a compact container having a content storage container horizontally coupled to a side surface of a pump, which includes a container body 10 and a container lid 20 hinge-coupled to one side of the container body 10 to be opened and closed.

The compact container includes a contents discharge frame 30 installed at one side of an inner portion of the container body 10 and provided at a center thereof with a pump mounting portion 32 in a vertical direction, in which a contents inlet port 34 is provided on one side of an outer periphery of the pump mounting portion 32 in a horizontal direction; a contents storage container 40 horizontally mounted on the contents inlet port 34 of the contents discharge frame 30; a pump 50 vertically mounted on the pump mounting portion 32 of the contents discharge frame 30 to pump contents; a distribution plate 60 coupled to an upper portion of the pump 50 and formed on an upper surface thereof with a discharge passage 62; a discharge plate 70 formed on an upper portion of the distribution plate 60 and formed with a plurality of outlet ports 71; and a fixing member 80 coupled to upper portions of the contents discharge frame 30 and the contents storage container 40 to fix the contents discharge frame 30 and the contents storage container 40.

The contents discharge frame 30 and the contents storage container 40 are contained in the container body 10.

A frame installing groove 14 in which the contents discharge frame 30 is installed and a storage container installing hole 16 in which the contents storage container 40 is installed are formed on an inner bottom surface of the container body 10.

A plurality of coupling protrusions 18 coupled to the fixing member 80 protrudes from an inner periphery surface of the container body 10.

The container lid 20 is hinge-coupled to one side of the container body 10 to open and close the container body 10.

The contents discharge frame 30 is installed into the frame installing groove 14 of the container body 10 and connects the contents storage container 40 and the pump 50 to each other such that contents are discharged from the contents storage container 40 when the pump 50 is operated while the contents storage container 40 and the pump 50 are coupled to each other.

The pump mounting portion is vertically formed at the center of the contents discharge frame 30. The contents inlet port 34 is horizontally formed on one side of an outer periphery of the pump mounting portion 32.

A pump installing groove 322 is formed on an inner periphery of the pump mounting portion 32 to fix the pump 50.

The contents inlet port 34 includes an inner extension protrusion wheel 342 and an outer extension protrusion wheel 344 spaced apart from an outside of the inner extension protrusion wheel 342 by a predetermined interval. A storage container installing groove 346 is formed on an inner periphery of the outer extension protrusion wheel 344 such that the contents storage container 40 is detachably coupled into the storage container installing groove 346.

A guide groove 36 having a cross shape is formed outside the pump mounting portion 32 of the contents discharge frame 30.

A plurality of installing grooves 38 coupled to the fixing member 80 is formed on an outer periphery surface of the contents discharge frame 30.

Contents are contained in the contents storage container 40. The contents storage container 40 is horizontally installed to the contents inlet port 34 of the contents discharge frame 30.

An inlet port 42 through which contents are input is formed on one side of the contents storage container 40. An inner periphery of the inlet port 42 is tightly closed to an outer periphery of the inner extension protrusion wheel 342 of the contents inlet port 34. A storage container installing protrusion wheel 422 is formed on an outer periphery of the inlet port 42 and coupled to a storage container installing groove 346 of the contents inlet port 34.

A lower cap 44 is coupled to an opposite side of the contents storage container 40 and a push plate 46 is formed in the contents storage container 40, such that the push plate 46 moves as the contents are exhausted and collects contents.

In addition, the contents storage container 40 may be formed in a form of a pouch container. When the contents storage container 40 is formed in a form of a pouch container, the contents storage container 40 is formed of a flexible film to be easily crushed in pumping. Preferably, the film may be formed of at least one of polyethylene phthalate (PET) resin, polyethylene, polypropylene and thermoplastic elastomer.

The pump 50 is vertically mounted on the pump mounting portion 32 of the contents discharge frame 30 to pump the contents contained in the contents storage container 40.

That is, the pump 50 is vertically mounted on the pump mounting portion 32 of the contents discharge frame and the contents storage container is coupled to the pump 50, thereby providing the pump installation space and the contents storage container installation space as separate and enabling storage of a large amount of contents in the compact container. In addition, the size of the contents storage container may be changed.

The pump 50 includes a cylinder 51 inserted into the pump mounting part 32 and formed with a contents suction hole 58, a check valve 52 for selectively opening and closing the contents suction hole 58, a sealing member 53 coupled to an upper portion of the cylinder 51 to seal the inside of the cylinder 51, a piston 54 formed inside the cylinder 51, a piston ring 55 fitted with an outside of the piston 54 to be tightly closed to an inner surface of the cylinder 51, a vertical moving member 56 coupled to an upper portion of the piston 54 to move up and down, and an elastic member 57 for elastically supporting the vertical moving member 56.

A contents transfer passage 514 is formed on a lower portion of the cylinder 51 such that the contents contained in the contents storage container 40 are movable into the pump 50. A pump mounting protrusion 512 is formed on an upper outer periphery of the cylinder 51 and fixedly coupled to the pump installing groove 322 of the pump mounting portion 32.

A distribution plate coupling groove 562 coupled to the distribution plate 60 is formed on an upper portion of the vertical moving member 56.

The distribution plate 60 is coupled to an upper portion of the pump 50 to diffuse contents.

A discharge path 61 for discharging the pumped contents and a discharge passage 62 communicating with the discharge path 61 to diffuse contents are formed on an upper surface of the distribution plate 60.

A sealing groove 64 is formed outside the discharge passage 62 of the distribution plate 60 and a sealing ring 68 is fitted into the sealing groove 64.

The sealing ring 68 may be formed of a rubber ring or a double sided tape. The sealing ring 68 provides the sealing or boding between the distribution plate 60 and the discharge plate 70.

A distribution plate coupling protrusion wheel 68 extends downward from the center of a lower surface of the distribution plate 60 and is fitted into the distribution plate coupling groove 562 of the vertical moving member 56.

A guide protrusion 66 having a cross shape, which guides the distribution plate 60 to vertically move, extends downward of the distribution plate 60 and is inserted into the guide groove 36.

The discharge plate 70 is attached to an upper portion of the distribution plate 60 by an adhesive tape, and is formed with a plurality of discharge ports 71.

The fixing member 80 is coupled to upper portions of the contents discharge frame 30 and the contents storage container 40 to fix the contents discharge frame 30 and the contents storage container 40.

A distribution plate hole (82) for exposing the discharge plate 70 and a puff keeping space 84 for keeping a puff P are formed on an upper portion of the fixing member 80.

A release preventing portion 822 protrudes inwardly from an outside of the discharge plate hole 82 to prevent the discharge plate 70 front being detached.

The puff keeping space 84 is located above the contents storage container 40 and is defined as if it is concaved inward of the container body 10.

A plurality of engaging recesses 86 are formed on the outer circumferential surface of the fixing member 80 and are engaged with the engaging protrusions 18 of the container body 10. A plurality of mounting protrusions 88 are formed on the inner circumferential surface, And is coupled to the mounting groove 38 of the frame 30

A fixture 90 is further formed between the discharge plate 70 and the fixing member 80 such that the distribution plate 60 and the discharge plate 70 are prevented from moving left and right.

The fixture 90 is formed in a rectangular ring shape to correspond to the discharge plate hole 82 of the fixing member 80.

The fixture 90 includes an inner extension piece 92 extending toward the center thereof to prevent the discharge plate 70 from being detached, a first lower extension piece 94 extending downwardly of the inner extension piece 92 to surround the discharge plate 70, and a second lower extension piece 96 extending downwardly of the first lower extension piece 94 to surround the distribution plate 60.

An upper end of the second extension piece 96 is tightly closed to the release preventing portion 822 of the fixing member 80.

Hereinafter, a method of assembling the compact container having a content storage container horizontally coupled to a side surface of a pump will be described as follows.

To assemble the compact container having a content storage container horizontally coupled to a side surface of a pump according to the present invention, as shown in FIGS. 4 and 5, the pump 50 is vertically mounted on the pump mounting portion 32 of the contents discharge frame 30.

Then, contents are injected into the contents storage container 40 and the inlet port 42 of the contents storage container 40 is horizontally installed into the contents inlet port 34 of the contents discharge frame 30. The storage container installing protrusion wheel 422 of the inlet port 42 is coupled into the storage container installing groove 346 of the contents inlet port 34.

Then, the distribution plate 60 is coupled to the upper portion of the pump 50. As shown in FIG. 6, the guide protrusion 66 of the distribution plate 60 is inserted into the guide groove 36 of the contents discharge frame 30.

Then, after the sealing ring 68 is fitted into the sealing groove 64 of the distribution plate 60, the distribution plate 70 and the fixture 90 are sequentially placed on an upper portion of the distribution plate 60.

Then, the contents discharging frame 30 assembled as described above is coupled to the lower side of the fixing member 80. The installing protrusion 88 of the fixing member 80 is coupled into the installing groove 38 of the contents discharge frame 30 while the fixture 90 is fitted into the discharge plate hole 82 of the fixing member 80.

Last, one side of the fixing member 80 is coupled to the container body 10 to which the container lid 20 is hinge-coupled and the contents discharge frame 30 and the contents storage container 40 are installed into the frame installing groove 14 and the storage container installing hole 16 of the container body 10, respectively, so that the assembly of the compact container having a content storage container horizontally coupled to a side surface of a pump according to the present invention is completed.

Hereinafter, the use of the compact container having a content storage container horizontally coupled to a side surface of a pump assembled as described above will be described as follows.

Figure 7:
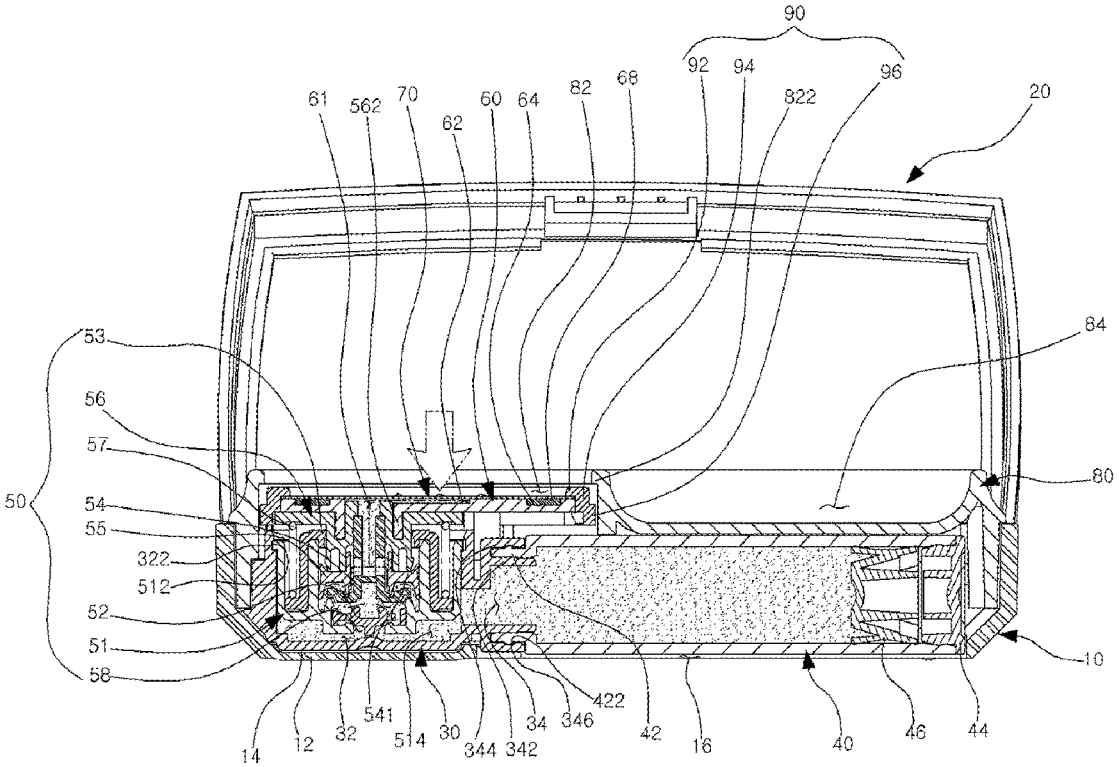
FIG. 7 is a sectional view taken along line A-A, which shows a state in which a discharge plate of a compact container having a contents storage container horizontally coupled to the lateral side of a pump according to the present invention is pressed.
Figure 8:
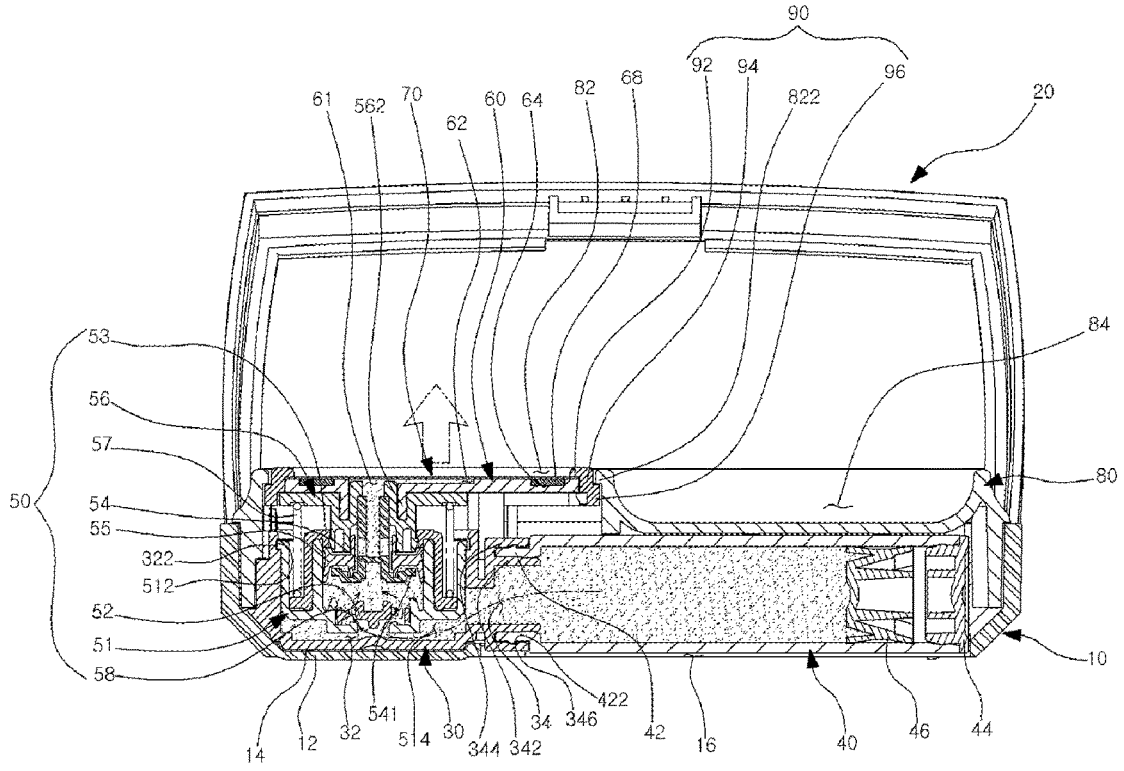
FIG. 8 is a sectional view taken along line A-A, which shows a state in which a compact container having a contents storage container horizontally coupled to the lateral side of a pump according to the present invention is released from pressure.

FIG. 7 is a sectional view taken along line A-A, which shows a state in which a discharge plate of a compact container having a contents storage container horizontally coupled to the lateral side of a pump according to the present invention is pressed. FIG. 8 is a sectional view taken along line A-A, which shows a state in which a compact container having a contents storage container horizontally coupled to the lateral side of a pump according to the present invention is released from pressure.

To use the compact container having a content storage container horizontally coupled to a side surface of a pump according to the present invention, the upper surface of the discharge plate 70 formed with the discharge ports 71 is first vertically pressed.

As shown in FIG. 7, when the discharge plate 70 is vertically pressed, the distribution plate 60 coupled to the discharge plate 70 is pressed and moved downward together with the discharge plate 70, and the vertical moving member 56 of the pump 50 coupled to the distribution plate 60 moves downward.

As the vertical moving member 56 moves downward, the piston 54 coupled to the lower side of the vertical moving member 56 is moved together downward. In this case, since the piston ring 55 is tightly closed to the inside surface of the cylinder 51, a gap is created between the piston 54 and the piston ring 55 as only the piston 54 moves downward, so that a discharge passage for contents is generated.

Thereafter, when the vertical moving member 56 is continuously pressed, the piston ring 55 contacts the vertical moving member 56 and moves downward together with the piston 54 so that the volume of the inside of the cylinder 51 is reduced. Thus, after the contents contained in the cylinder 51 pass between the piston 54 and the piston ring 55 and pass through the inside of the piston 54, the contents pass through the discharge passage 62 of the distribution plate 60 and are discharged through the discharge port 70.

At the same time, the check valve 52 closes the contents suction hole 58 formed on the bottom surface of the cylinder due to the discharge pressure in the cylinder 51.

Thereafter, as shown in FIG. 8, when the pressure on the discharge plate 70 is removed, the vertical moving members 56 moves upward by the elasticity of the elastic member 57 that elastically supports the vertical moving member 56, and the piston 54 coupled to the lower side of the vertical moving member 56 moves upward. In this case, the extension protrusion wheel 541 formed on the outside of the lower end of the piston 54 lifts the piston ring 55 upward, so that the gap between the piston 54 and the piston ring 55 is blocked and the piston 54 and the piston ring 55 move upward together to increase the volume of the inside of the cylinder 51, thereby generating vacuum pressure.

While the check valve 52 is lifted up by the vacuum pressure generated in the cylinder 51, the contents suction hole 58 formed on the bottom surface of the cylinder 51 is opened. Thus, the contents contained in the contents storage container 40 are introduced into the cylinder 51 via the contents suction hole 58 through the contents transfer passage 514 of the cylinder 51, and at the same time, the push plate 46 installed in the contents storage container 40 moves forward.

As described above, the compact container having a contents storage container horizontally coupled to the lateral side of a pump described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container body
14: Frame installing groove
16: Storage container installing hole
20: Container lid
30: Contents discharge frame
32: Pump mounting portion
34: Contents inlet port
36: Guide groove
40: Contents storage container
42: Inlet port
50: Pump
51: Cylinder
60: Distribution plate
66: Guide protrusion
70: Discharge plate
80: Fixing member
82: Discharge plate hole
84: Puff keeping space
90: Fixture
P: Puff

The invention claimed is:

1. A compact container having a content storage container horizontally coupled to a side surface of a pump, the compact container comprising:

a container body (10);

a container lid (20) hinge-coupled to one side of the container body (10) to be opened and closed;

a contents discharge frame (30) installed at one side of an inner portion of the container body (10) and a pump mounting portion (32) provided at a center of the contents discharge frame (30) in a vertical direction, in which a contents inlet port (34) is provided on one side of an outer periphery of the pump mounting portion (32) in a horizontal direction;

the content storage container (40) horizontally mounted on the contents inlet port (34) of the contents discharge frame (30);

a pump (50) vertically received in the pump mounting portion (32) of the contents discharge frame (30) to pump contents therethrough vertically towards a distribution plate (60) coupled to an upper portion of the pump (50), the distribution plate (60) including a discharge passage (62) formed on an upper surface thereof;

a discharge plate (70) formed on an upper portion of the distribution plate (60) and formed with a plurality of outlet ports (71); and a fixing member (80) coupled to upper portions of the contents discharge frame (30) and the contents storage container (40) to fix the contents discharge frame (30) and the contents storage container (40), wherein a diameter of the pump (50) is less than the diameter of the pump mounting portion (32).

2. The compact container of claim 1, wherein a guide groove (36) having a cross shape is formed outside the pump mounting portion (32) of the contents discharge frame (30), and a guide protrusion (66) having a cross shape extends downward of the distribution plate (60) and is inserted into the guide groove (36).

3. The compact container of claim 1, wherein a sealing groove (64) is formed outside the discharge passage (62) of the distribution plate (60), a sealing ring (68) is fitted into the sealing groove (64), and the sealing ring (68) is formed of a rubber ring or a double sided tape.

4. The compact container of claim 1, wherein a distribution plate hole (82) for exposing the discharge plate (70) and a puff keeping space (84) for keeping a puff (P) are formed on an upper portion of the fixing member (80).

5. The compact container of claim 1, further comprising a fixture (90) formed between the discharge plate (70) and the fixing member (80).

* * * * *